United States Patent [19]

Gaylord

[11] 4,215,663

[45] * Aug. 5, 1980

[54] AIR-FUEL INLET DEVICE FOR INTERNAL COMBUSTION ENGINES

[76] Inventor: James K. Gaylord, 419 Sheridan Rd., Winnetka, Ill. 60093

[ * ] Notice: The portion of the term of this patent subsequent to May 16, 1978, has been disclaimed.

[21] Appl. No.: 887,945

[22] Filed: Mar. 20, 1978

Related U.S. Application Data

[63] Continuation-in-part of Ser. No. 712,654, Aug. 9, 1976, Pat. No. 4,086,899.

[51] Int. Cl.[2] ..... F02M 29/00

[52] U.S. Cl. ..... 123/590; 261/78 R; 48/180 R

[58] Field of Search ..... 123/141; 261/78 R; 48/180 R, 180 C, 180 M, 180 P, 180 S, 180 H, 180 B, 180 F, 180 A

[56] References Cited

U.S. PATENT DOCUMENTS

| | | | |
|---|---|---|---|
| 921,934 | 5/1909 | Willard | 48/180 M |
| 1,093,385 | 4/1914 | Clemmer | 48/180 R |
| 1,121,868 | 12/1914 | Riotte et al. | 123/141 |
| 1,472,665 | 10/1923 | Mowen | 48/180 R |
| 1,483,314 | 2/1924 | Rosenbrook | 48/180 M |
| 1,522,205 | 1/1925 | Petrovsky | 48/180 M |
| 1,652,010 | 12/1927 | Holloway | 48/180 B |
| 2,639,230 | 5/1953 | Lefebre | 123/141 |
| 3,645,243 | 2/1972 | Ohlsson | 48/180 R |
| 4,086,899 | 5/1978 | Gaylord | 123/141 |

FOREIGN PATENT DOCUMENTS

| | | | |
|---|---|---|---|
| 1019861 | 11/1957 | Fed. Rep. of Germany | 123/141 |

*Primary Examiner*—Ira S. Lazarus

*Attorney, Agent, or Firm*—Gary, Juettner & Pyle

[57] ABSTRACT

An air-fuel inlet device for an internal combustion engine is characterized by a spacer having passages therethrough with recesses formed in the side walls of the passages. The spacer is positionable between a carburetor and an intake manifold of an engine with the passages establishing communication between the outlets from the carburetor and associated inlets to the manifold, and results in significantly increased engine efficiency, decreased fuel consumption and decreased exhaust emissions.

23 Claims, 3 Drawing Figures

42
40
22
28
34
36
38
30
24
26

38
34
36

AIR-FUEL INLET DEVICE FOR INTERNAL COMBUSTION ENGINES

BACKGROUND OF THE INVENTION

This is a continuation-in-part application of prior application Ser. No. 712,654, filed Aug. 9, 1976, now U.S. Pat. No. 4,086,899.

The invention relates to a device for use in the air-fuel inlet system of an internal combustion engine to increase the efficiency thereof and to decrease emissions exhausted therefrom.

Various devices for use in the air-fuel inlet systems of internal combustion engines, particularly automotive engines, have heretofore been developed. Such devices are alleged to increase fuel economy and, in some cases, to decrease exhaust emissions.

Included among such devices, by way of example, are those positionable between the carburetor and the intake manifold of the engine to intercept the air-fuel mixture. The devices are generally said to operate on the mixture, such as by imparting an electrostatic charge thereto or by "chopping" the mixture to more finely divide the fuel particles and to disperse a uniform fuel mixture uniformly to all the cylinders to the engine. This should result in, and the prior art devices were supposedly intended to produce the result of, increased engine performance and miles per gallon, and decreased emissions.

Because of growing concern for a clean environment and decreased fuel consumption, large numbers of such devices have been purchased and installed on automobile engines. Many of the devices are cumbersome and difficult to install, or when used in accordance with instructions require changes in engine timing. Unfortunately, in their use they have been found to yield little if any improvement in fuel economy or decrease in emissions. To the contrary, use of some of the devices actually results in increased fuel usage and poor engine performance. Furthermore, with those devices requiring a change in engine timing, generally an over-advanced timing, engine damaging spark knock frequently occurs, which often cannot be eliminated even with use of a more expensive, higher octane rated gasoline.

Because of the inability of these prior art devices to fulfill the purposes for which they were promoted, the general concept of in-line carburetor attachments has fallen into a degree of disrepute, although some devices such as high rise headers are still actively promoted. For the most part, however, the art has looked for different solutions.

THE INVENTION

The present invention is based on the almost accidental discovery that an in-line spacer having internal passages constructed with recesses therein will in fact improve engine performance, decrease fuel consumption, and decrease exhaust emissions.

OBJECTS OF THE INVENTION

The primary object of the present invention is to provide a device for use in the air-fuel system of an internal combustion engine which will actually increase the efficiency and power output of the engine while simultaneously decreasing fuel consumption.

Another object of the invention is to provide such a device which reduces emissions exhausted from the engine.

Yet another object is to provide such a device of simple and economical construction which may be simply and inexpensively installed on the engine.

SUMMARY OF THE INVENTION

In accordance with the present invention, a device for use between a carburetor and an intake manifold of an internal combustion engine is characterized by a spacer positionable between the base of the carburetor and the inlet of the manifold and having, as necessary, one or more passages therethrough for aligned communication between the carburetor outlet and the manifold inlet, the wall surface of each passage being formed with recesses therein.

In the preferred embodiment, each passage through the spacer has an inner diameter substantially equal to the diameter of the corresponding carburetor outlet. The recesses formed in the wall surface of the passage are spaced parallel grooves disposed perpendicular to the axis of the passage, and the number and the size of the passages in the spacer is determined by the number and the size of the outlets or barrels in the carburetor.

While the exact theory of operation of the spacer of the invention is not known and can only be theorized as discussed in the following detailed description, it has been discovered that use of the spacer significantly increases engine efficiency, decreases fuel consumption, and decreases exhaust emissions.

Other objects, advantages and features of the invention will become apparent from the following detailed description when taken in conjunction with the accompanying drawings.

DETAILED DESCRIPTION

Figure 1:
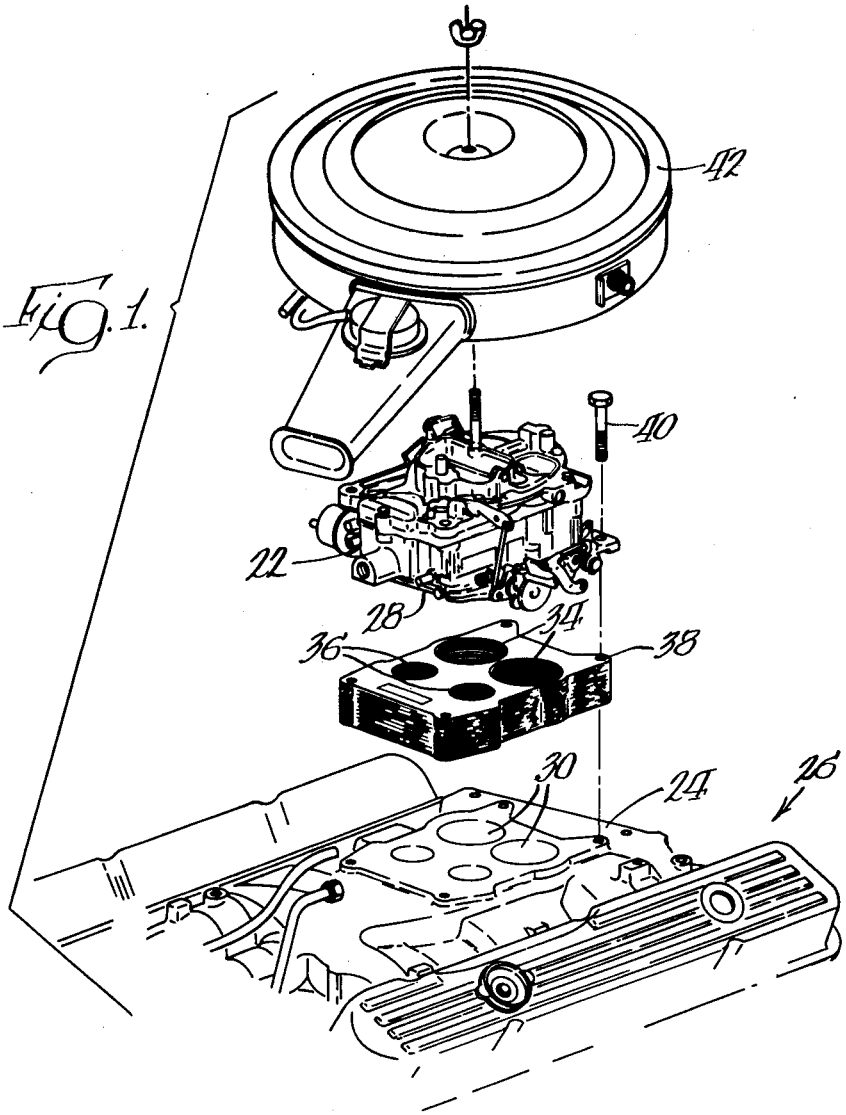
FIG. 1 is an exploded perspective view showing the manner in which a spacer embodying the teachings of the present invention is positioned between the carburetor and the intake manifold of an internal combustion engine having a four-barrel carburetor.
Figure 2:
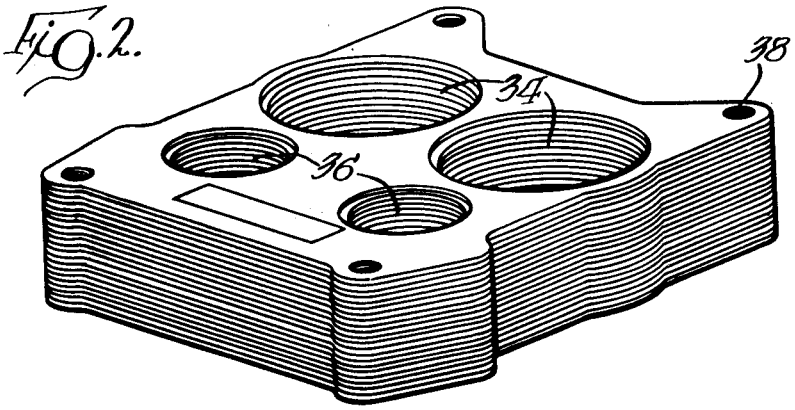
FIG. 2 is an enlarged perspective view of the spacer shown in FIG. 1.

Referring to FIGS. 1 and 2 of the drawings, a spacer 20, structured in accordance with the teachings of the present invention, is adapted to be positioned between a carburetor 22 and an intake manifold 24 of an internal combustion engine 26. The spacer illustrated is for use with a four-barrel (two primary and two secondary barrels) carburetor, and as such has four passages formed therethrough. It is to be understood, however, that the teachings of the invention also apply to spacers for use with carburetors having any other number of barrels, such spacers having one passage therethrough for single-barrel carburetors, two passages therethrough for two-barrel carburetors, etc.; and that the teachings of the invention are generally applicable to air-fuel mixture supply systems other than those encountered in automobile internal combustion engines.

The carburetor barrels extend from inlets at the upper end of the carburetor to outlets in a base 28 of the carburetor, and in the absence of the spacer, the secondary barrel outlets communicate directly with a pair of relatively enlarged inlets 30 in the manifold, and the primary barrel outlets communicate directly with a pair of somewhat smaller manifold inlets 32, to provide an air-fuel mixture to the manifold. The configuration of the spacer conforms generally with the base of the carburetor and the inlet area or surface of the manifold. When positioned between the base of the carburetor and the inlet surface of the manifold, the spacer 20 defines a pair of relatively enlarged passages 34 which align axially with the carburetor secondary outlets and the corresponding manifold inlets 30, and a pair of relatively smaller passages 36 which align axially with the carburetor primary outlets and the manifold inlets 32. The passages 34 and 36 are of generally like diameter with their associated carburetor outlets.

A plurality of holes 38 are formed through the spacer in positions to accomodate the carburetor to manifold mounting bolts 40, or to receive upstanding carburetor mounting studs (not shown), whereby the spacer is properly aligned with the carburetor and the manifold, and the carburetor may readily be mounted to the manifold with the spacer compressed therebetween. As is customary, an air filter 42 filters the air drawn into the carburetor.

It has been discovered that when the surfaces of the passages 34 and 36 through the spacer 20 are formed with recesses therein, significant increases in engine efficiency and performance are obtained, with corresponding reductions in exhaust emissions. For example, and referring to FIGS. 2 and 3, it has been found that when a spacer is of a thickness to support the base of the carburetor about one inch above the manifold inlets, and when the surfaces of the passages through the spacer are formed with a plurality of spaced, annular recesses 44, the aforementioned improved engine efficiency results. In this case, the recesses may be of generally square cross section, lie in planes perpendicular to the axes of the passages, have a nominal width and depth of 1/16 inch, and be spaced apart 1/16 inch along the length of the passages. The recesses then define therebetween and along the passages a plurality of spaced, annular surface segments 46, having a nominal width and height of 1/16 inch and generally square corners.

Figure 3:
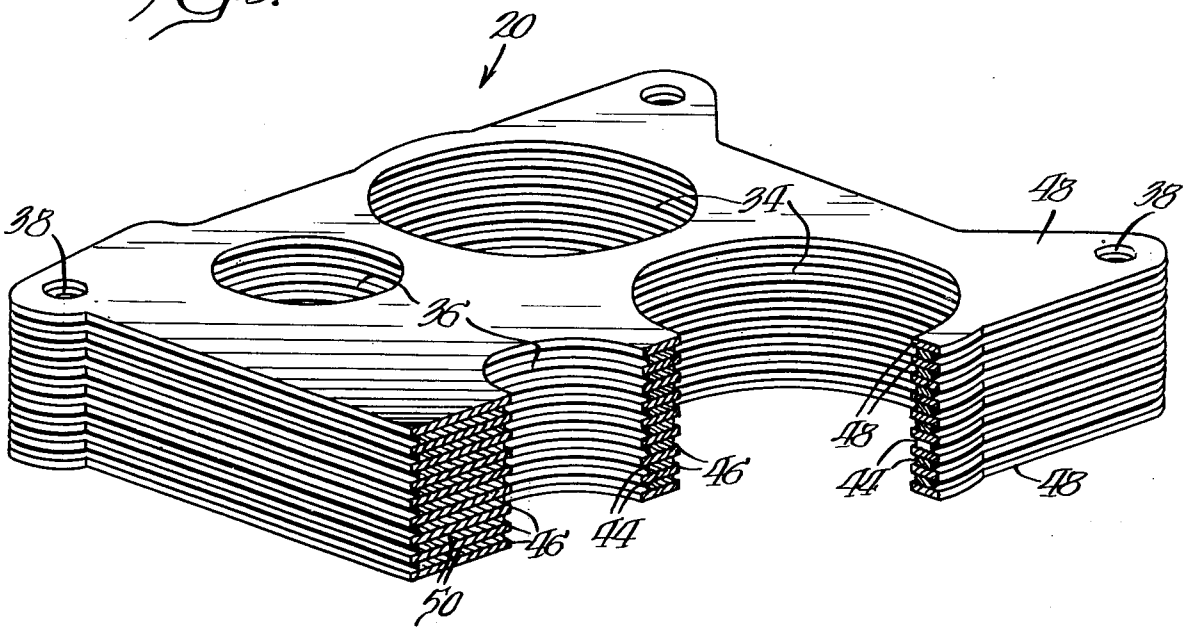
FIG. 3 is a fragmentary perspective view of the spacer, illustrating one construction thereof and one surface configuration of passages therethrough.

The spacer 20 may be of monolithic structure with the recesses machined into the passage walls, or in the case where the recesses are annular it may be of quasimonolithic structure comprised of a plurality of joined sections, or it may be comprised of an assembled stack of individual plates. In a contemplated economical mode of manufacture of the spacer specifically disclosed, the spacer is formed of a stack of individual interleaved plates each nominally 1/16 inch thick. Referring to FIG. 3, with this construction the spacer includes a first set of 1/16 inch thick plates 48, each having passages formed therethrough equal in number to the outlets from the carburetor and axially alignable and of equal diameter therewith. The spacer also includes a second set of 1/16 inch thick plates 50, each having passages formed therethrough equal in number to the outlets from the carburetor and axially alignable therewith, and of a diameter substantially ⅛ inch greater than the diameter of their associated outlets.

The plates of the first and second sets are interleaved in alternate fashion to form a stack, which when compressed in use will be about one inch thick, with the passages axially algined. To facilitate handling of the stack, the plates 48 and 50 may be aligned by use of the bolt holes 38 and may then be bonded together with a suitable adhesive or cement. In the preferred construction, the plates 48 are of a gasket material, such as cork, asbestos or the like, and the plates 50 are of a metal such as aluminum.

In order for the spacer to support the base of the carburetor about one inch over the intake manifold, when each plate has a nominal thickness of 1/16 inch, and when the plates of one set are formed of compressible gasket material, it is necessary to employ more than sixteen plates. In the spacer shown, for example, the gasket material plates 48 are compressible, while the metal plates 50 are not, and to obtain a thickness of about one inch when the spacer is compressed between the carburetor and the manifold, it is necessary to use nine gasket material plates and eight metal plates with gasket material plates exposed to the opposite ends of the stack. Thus, the stack as manufactured has a total uncompressed thickness of 1 1/16 inch. Should the plates of both sets be of compressible material, or should the spacer be made in another manner from compressible material, then the dimensions would be selected, dependent upon the degree of compression to which subjected in use, to provide a desired thickness in the compressed state. On the other hand, if the plates of both sets were incompressible, or should the spacer be made an incompressible monolithic structure, then the dimensions of the spacer as manufactured would be the same as when it is mounted between the carburetor and manifold.

It is not precisely known how the spacer of the invention increases engine efficiency and performance while decreasing emissions. However, experimentation has shown that it does. Although it cannot be stated with certainty, it is believed that the benefits derived are attributable to the recesses 44 providing spaces for the formation of trapped vortices of fluid upon flow of an air-fuel mixture through the passages in response to manifold vacuum. It is theorized that torroidal trapped vortices of fluid are formed in the recesses 44 which, in a sense, act as very low friction "ball bearings" relative to the flow of the air-fuel mixture through the passages. Also, these trapped vortices possibly could cause a quiescent stagnant boundary layer of the mixture to build up adjacent the passage walls and to extend smoothly inward of the centers of the passages to slightly restrict the flow areas therethrough. The boundary layers would then provide smooth surfaces for laminar flow of the mixture through the passages, and the restricted flow areas would cause an acceleration of the mixture. This in turn would result in an increased velocity and greater volume of the mixture entering the intake manifold, with consequent improved dispersion of the mixture to all cylinders of the engine. Further it is possible that the additional flow length of the mixture through the spacer passages, as well as the increased velocity of flow therethrough, results in a more homogeneous air-fuel mixture entering the manifold. As a consequence, all of the cylinders of the engine would be supplied substantially uniformly with a substantially uniform, homogeneous mixture of fuel and air which would not only result in balanced combustion between the cylinders, but also in more efficient combustion therewithin. This, then, could account for the measurably improved engine efficiency and performance, decreased fuel consumption, and decreased exhaust emissions obtained by use of the spacer.

The foregoing specifically described structure of the spacer has the advantage that the spacer may be easily and economically assembled, simply by interleaving first and second sets of plates. In consequence, the recesses formed in the passage surfaces are annular, parallel and of generally square cross section. It is to be appreciated, however, that it is within the contemplation of the invention and its teachings to form passage surface recesses of other configurations. For example, the recesses could be of "V", semi-circular, rectangular or other cross section, since such recesses would similarly trap torroidal vortices. In addition, the recesses need not necessarily be annular and parallel. By way of example, a single recess could be formed in a spiral through each passage. Such a spiraling recess should, however, have a relatively small pitch, in order that its length extends somewhat perpendicular to an air-fuel mixture flowing therepast, whereby vortices will be formed in the recess. In addition, the spacer need not be exactly one inch thick, but may be selected to be of a thickness to maximize the economy and performance of an internal combustion engine with which it is used, since various engines likely may require spacers of different thicknesses in order to obtain maximum economy and performance.

COMPARATIVE TESTS

To best illustrate the specific advantages of increased economy and performance and described emissions obtained with use of the spacer of the invention, comparative tests were conducted with automobiles equipped with and without the spacer, as well as with spacers having dimensions modified from those found to provide maximized economy and performance. The automobiles all had automatic transmissions and cruise controls. For tests relating to economy and emissions, the cruise controls were used to maintain vehicle speed as constant as possible. For tests relating to performance (acceleration), several runs were made to predetermined speeds and the elapsed times averaged.

The following tests 1–6 were conducted with a 1975 Chevrolet Monte Carlo having a 350 cubic inch displacement engine, a two-barrel carburetor, and a single exhaust:

ECONOMY AND EMISSIONS

| | Test number (see notes) | | | |
|---|---|---|---|---|
| | 1 | 2 | 3 | 4 |
| Total mileage | 216.2 | 216.2 | 216.8 | 98.8 |
| Average speed | 51.3 | 50.7 | 51.0 | 49.3 |
| Miles per gallon | 17.7 | 18.6 | 15.9 | 17.0 |
| Carbon monoxide at 55 m.p.h. (%) | 2.0 | 1.0 | 1.34 | .93 |
| Carbon monoxide at idle (%) | .87 | .25 | .75 | .37 |

Notes on the tests:
Test No. 1 - Conducted without a spacer.
Test No. 2 - Conducted with a spacer substantially one inch thick and having annular 1/16 inch square recesses spaced apart by 1/16 inch.
Test No. 3 - Conducted with a spacer substantially one inch thick but without recesses in the passages thereof.
Test No. 4 - Conducted with a spacer substantially one inch thick and having recesses in the passages thereof 5/64 inch deep.

PERFORMANCE

| | Test number (see notes) | |
|---|---|---|
| | 5 | 6 |
| Acceleration 0–60 m.p.h. | 12.44 sec. | 12.1 sec. |

-continued

PERFORMANCE

| | Test number (see notes) | |
|---|---|---|
| | 5 | 6 |
| Acceleration 20–50 m.p.h. | 7.16 sec. | 6.1 sec. |

Notes on the tests:
Test No. 5 - Conducted without a spacer.
Test No. 6 - Conducted with a spacer substantially one inch thick and having annular 1/16 inch square recessed spaced apart by 1/16 inch.

The following tests 7–12 were conducted with a 1976 Cadillac Fleetwood having a 500 cubic inch displacement engine, a four-barrel carburetor, and a single exhaust.

ECONOMY AND EMISSIONS

| | Test number (see notes) | | | |
|---|---|---|---|---|
| | 7 | 8 | 9 | 10 |
| Total mileage | 51.5 | 51.4 | 50.6 | 50.5 |
| Average speed | 47.5 | 49.0 | 47.43 | 49.7 |
| Miles per gallon | 15.35 | 15.35 | 14.25 | 14.22 |
| Carbon monoxide at 55 m.p.h. (%) | 0 | 0 | 0 | 0 |
| Carbon monoxide at idle (%) | 0 | 4 | 0 | 2.5 |

Notes on the tests:
Tests Nos. 7 and 8 - Conducted with a spacer substantially one inch thick and having annular 1/16 inch square recessed spaced apart by 1/16 inch.
Tests Nos. 9 and 10 - Conducted without a spacer.

PERFORMANCE

| | Test number (see notes) | |
|---|---|---|
| | 11 | 12 |
| Acceleration 0–60 m.p.h. | 11.33 | 10.7 |
| Acceleration 20–50 m.p.h. | 6.23 | 6.1 |

Notes on the test:
Test No. 11 - Conducted without a spacer.
Test No. 12 - Conducted with a spacer substantially one inch thick and having annular 1/16 inch square recesses spaced apart by 1/16 inch.

The following tests 13 and 14 were conducted with a 1973 Oldsmobile 98 Regency having a 455 cubic inch displacement engine, a four-barrel carburetor, and dual exhausts.

ECONOMY

| | Test number (see notes) | |
|---|---|---|
| | 13 | 14 |
| Total mileage | 310.4 | 310.7 |
| Average speed | 55 | 55 |
| Miles per gallon | 14.82 | 16.31 |

Notes on the tests:
Test No. 13 - Conducted without a spacer.
Test No. 14 - Conducted with a spacer substantially one inch thick having annular 1/16 inch square recesses spaced apart by 1/16 inch.

As seen from the data, both the two and four-barrel carburetor equipped automobiles exhibited increased economy (miles per gallon) and performance (acceleration) when operated with a spacer dimensioned in accordance with one embodiment of the invention, as compared with the same automobiles when operated without the spacer. In tests 1–6 using a far less sophisticated and far less expensive automobile, and one which is in far more popular use, the spacer also drastically reduced exhaust emissions. Tests Nos. 13 and 14 demonstrate a significant 10% increase in fuel economy by use of the spacer.

While the illustrated embodiments of the invention have been described as a spacer for insertion between the carburetor and intake manifold of an internal combustion engine, the invention contemplates, and is intended to include, by way of example, integral formation of the spacer as an extension of either the manifold inlet or the base of the carburetor to define one or more air-fuel passages structured and dimensioned in accordance with the teachings of the invention. Also, while embodiments of the invention have been described in detail, various other modifications and embodiments thereof may be devised by one skilled in the art without departing from the spirit and the scope of the invention, as defined by the appended claims.

What is claimed is:

1. A device for use between a carburetor and an intake manifold of an internal combustion engine to increase the efficiency and performance of the engine, the carburetor being of a type having a base and an outlet therein for communication with an associated inlet in the manifold for providing an air-fuel mixture therein, said device comprising a spacer having a passage therethrough for being positioned between the carburetor base and the manifold with said passage alignable with the carburetor outlet and the manifold inlet, the surface of said passage having a plurality of recesses of substantially rectangular, but not square, cross section therein.

2. A device as set forth in claim 1, said passage being cylindrical and said recesses comprising annular spaced parallel recesses lying in planes essentially perpendicular to the axis of said passage.

3. A device for use between a carburetor and an intake manifold of an internal combustion engine to increase the efficiency and performance of the engine, the carburetor being of a type having a base and at least one outlet therein for communication with at least one associated inlet in the manifold for providing an air-fuel mixture thereto, said device comprising a spacer for being positioned between the carburetor base and the manifold for maintaining a spacing between the base and manifold, said spacer being formed with unobstructed passages therethrough of the same number as the outlets from the carburetor and the inlets to the manifold and respectively alignable therewith, each passage being associable with an individual one of the outlets and inlets upon said spacer being positioned between the base and the manifold and having an inner diameter substantially equal to the diameter of the respective outlet and inlet for aligned communication therebetween, each passage having a plurality of recesses of substantially rectangular cross section formed therein along its length.

4. A device as set forth in claim 3, said recesses being formed circumferentially in each said passage.

5. A device as set forth in claim 3, said recesses in each of said passages comprising spaced parallel annular recesses lying in planes perpendicular to the axis of said passage.

6. A device for use between a carburetor and an intake manifold of an internal combustion engine to increase the efficiency and performance of the engine, the carburetor being of a type having a base and at least one outlet therein for communication with at least one associated inlet in the manifold for providing an air-fuel mixture therein, said device comprising a spacer for being positioned between the carburetor base and the manifold for maintaining a spacing between the base and manifold, said spacer being formed with the same number and size of passages therethrough as the outlets from the carburetor and the inlets to the manifold and respectively alignable therewith, each passage being associable with an individual one of the outlets and inlets upon said spacer being positioned between the base and the manifold and having an inner diameter substantially equal to the diameter of the respective outlet and inlet for aligned communication therebetween, each passage having a plurality of recesses formed therein along its length, said spacer including a first set of plates having passages therethrough each of a diameter substantially equal to the diameter of the associated carburetor outlet and manifold inlet, and a second set of plates having passages therethrough each of a diameter greater than the diameter of the associated carburetor outlet and manifold inlet, said plates of said first and second sets being interleaved in a stack to alternate said plates of said first and second sets and to coaxially align said passages therethrough.

7. A device for mounting a carburetor to an intake manifold of an internal combustion engine, the carburetor being of a type having an outlet for communication with an inlet to the manifold to provide an air-fuel mixture thereto, said device comprising means for being positioned between the carburetor outlet and the manifold inlet for mounting the outlet spaced from the inlet, said means having an unobstructed passage for extending between the outlet and the inlet, said passage having a surface formed with recesses of substantially rectangular cross section along its length.

8. A device as set forth in claim 7, said recesses being annular recesses spaced along the length of said passage.

9. A device as set forth in claim 7, said passage being of an inner diameter substantially equal to the diameter of the outlet, said recesses being equally spaced along the length of said passage and lying in planes perpendicular to the axis thereof.

10. A device for mounting a carburetor to an intake manifold of an internal combustion engine to increase the efficiency and performance of the engine, the carburetor being of a type having an outlet for communication with an inlet to the manifold to provide an air fuel mixture thereto, the device comprising spacer means for being positioned between the carburetor outlet and the manifold inlet for mounting the outlet spaced from the inlet, said spacer means having a circular passage extending between the carburetor outlet and the manifold inlet, said passage having a surface formed with a plurality of ridges of substantially rectangular cross section thereon, the ends of said ridges lying on a cylinder.

11. A device as set forth in claim 10, said at least one ridge comprising a plurality of annular spaced ridges along the length of said passage.

12. In an air intake passage for conveying at least the air portion of an air-fuel mixture for an internal combustion engine, which increases the efficiency and performance of the engine, a plurality of ridges of substantially rectangular cross section formed on the surface of said passage and extending inwardly of said passage, said ridges being annular and of equal inner diameters.

13. In an air intake passage for conveying at least the air portion of an air-fuel mixture for an internal combustion engine, which increases the efficiency and performance of the engine, a plurality of spaced recesses of substantially rectangular cross section formed in and along a surface of said passage, said recesses forming ridges therebetween the ends of which lie on said passage surface.

14. In an air intake passage as set forth in claim 13, said plurality of recesses comprising a plurality of spaced annular recesses extending along said passage.

15. A method of increasing the economy and performance of an internal combustion engine having an air intake passage for conveying at least the air portion of an air-fuel mixture for the engine, comprising the step of forming a plurality of ridges of substantially rectangular cross section on the surface of said passage, said ridges extending equal distances from the surface of said passage inwardly of said passage.

16. A method as set forth in claim 15, said forming step comprising forming a plurality of spaced annular ridges extending along said passage.

17. A method of increasing the economy and performance of an internal combustion engine having an air intake passage for conveying at least the air portion of an air-fuel mixture for the engine, comprising the step of forming a plurality of recesses of substantially rectangular cross section in the surface of said passage to define between said recesses a plurality of ridges the ends of which lie on said passage surface.

18. A method as set forth in claim 17, said forming step comprising forming a plurality of spaced annular recesses extending along said passage.

19. A device for being positioned in line with an intake conduit for conveying at least the air portion of an air-fuel mixture for an internal combustion engine to increase the efficiency and performance of the engine, comprising a housing positionable in line with the conduit and having an unobstructed passage therethrough alignable with the conduit, said passage having a generally uniform cross sectional area along its length and a plurality of spaced recesses of substantially rectangular cross section formed in its surface, said recesses forming ridges therebetween the ends of which lie on said passage surface.

20. A device in accordance with claim 19, wherein said passage is of circular cross section, and said recesses are annular, equally spaced along the length of said passage, of a first diameter, define annular ridges therebetween of a second, smaller and like diameter with said passage, and have imperforate inner surfaces.

21. A device in accordance with claim 19, wherein said recesses are spaced along the length of said passage, extend around said passage and lie in planes perpendicular to the length of said passage, each of said recesses and ridges having an equal length along the length of said passage.

22. A device in accordance with claim 19, wherein said recesses extend for a length of substantially $\frac{3}{4}$ to $1\frac{1}{4}$ inch along said passage.

23. A device for use in a fuel supply system, comprising a spacer insertable in the supply system and having a passage therethrough for transmission of the fuel, the surface of said passage having a plurality of recesses of substantially rectangular cross section therein, said spacer being of a thickness to maintain a passage length of substantially $\frac{3}{4}$ to $1\frac{1}{4}$ inch in said supply system.

* * * * *